US005589807A

United States Patent [19]

Tang

[11] Patent Number: 5,589,807

[45] Date of Patent: Dec. 31, 1996

[54] MULTI-MODE TEMPERATURE COMPENSATED FILTERS AND A METHOD OF CONSTRUCTING AND COMPENSATING THEREFOR

[75] Inventor: Wai-Cheung Tang, Ontario, Canada

[73] Assignee: COM Dev. Ltd., Cambridge, Canada

[21] Appl. No.: 475,656

[22] Filed: Jun. 7, 1995

[30] Foreign Application Priority Data

Jul. 7, 1994 [CA] Canada ..... 2127609

[51] Int. Cl.[6] ..... H01P 1/208; H01P 7/06

[52] U.S. Cl. ..... 333/212; 333/229; 333/234

[58] Field of Search ..... 333/202, 212, 333/219.1, 227–232, 234, 235

[56] References Cited

U.S. PATENT DOCUMENTS

| | | | |
|---|---|---|---|
| 2,475,035 | 7/1949 | Linder | 333/229 |
| 4,060,779 | 11/1977 | Atia et al. | 333/212 X |
| 4,644,305 | 2/1987 | Tang et al. | 333/212 X |
| 5,012,211 | 4/1991 | Young et al. | 333/212 |

FOREIGN PATENT DOCUMENTS

| | | | |
|---|---|---|---|
| 5-259719 | 10/1993 | Japan | 333/229 |

*Primary Examiner*—Benny Lee

*Assistant Examiner*—Justin P. Bettendorf

*Attorney, Agent, or Firm*—Daryl W. Schnurr

[57] ABSTRACT

Multi-mode waveguide filters are temperature compensated using dielectric material contained within at least one cavity of a filter. The variation in operating frequency of the filter that would otherwise result from changes in temperature is substantially balanced by a change in operating frequency with temperature caused by a change in a dielectric constant of the dielectric material so that the operating frequency of the filter remains substantially constant with temperature. The filter can have one or more dual-mode or triple-mode cavities. In a method of constructing and compensating a filter, the amount of dielectric material is selected so that the dielectric material does not resonate at the operating frequency of the cavity, the amount of dielectric material in the cavity being adjustable after each cavity is constructed. The cavity is operated with a fixed amount of dielectric material contained in the cavity for each mode and the change in operating frequency of the filter with temperature is determined. If the change in operating frequency of the filter is not at an acceptable level, the amount of dielectric material contained in the cavity for each mode is varied and the filter is operated through a range of temperatures to determine whether the change in operating frequency is then at an acceptable level. These steps are repeated until the change in operating frequency of the filter is at an acceptable level.

48 Claims, 12 Drawing Sheets

WITHOUT DIELECTRIC MATERIAL

Start 10.4 GHz
Stop 10.7 GHz

WITH DIELECTRIC MATERIAL

Start 10.4 GHz
Stop 10.7 GHz

Dielectric Shift - 30 MHz Normalized Loss vs Temperature
(col and test at each temp)

MULTI-MODE TEMPERATURE COMPENSATED FILTERS AND A METHOD OF CONSTRUCTING AND COMPENSATING THEREFOR

BACKGROUND OF THE INVENTION

1. Field of the Invention

This invention relates to multi-mode waveguide filters having temperature compensated dielectric-loaded resonant cavities and to a method of constructing and compensating such filters so that an operating frequency of the filter is substantially constant over a range of temperatures.

2. Description of the Prior Art

When waveguide filters are used on satellites in satellite communications systems, the filters are subjected to harsh environmental conditions. Any components used on a satellite are subjected to stringent weight and volume limitations. It is always desirable to miniaturize satellite components as much as reasonably possible. Usually, less power is required to operate a smaller component than a large component. This allows the satellite to have a smaller amount of power available, which results in a saving of weight and volume or the same amount of power can be made available but can be used to launch and to operate additional components. When satellite components occupy a smaller volume and have a lesser weight, then the satellite can be made smaller and less thrust or power is required to launch the satellite, resulting in substantial cost savings. Alternatively, the space made available on the satellite by reducing the volume and weight of components allows that space to be used for other purposes if the size of the satellite is kept the same. Filters used on satellites are subjected to a wide range of temperatures and often temperature control systems are required on satellites to maintain the temperature of the filters within a certain acceptable narrow range. The temperature control system has a weight and volume that must be taken into account in the overall satellite design. The temperature control system also consumes power as the satellite is operating. If the temperature control system for filters can be eliminated on satellites, substantial cost savings can be achieved.

Temperature compensation of waveguide filters is a desirable result that has been sought for many years. Typically, the material from which a filter cavity is made has a positive coefficient of thermal expansion. As temperature increases, the material expands and the volume of the cavity increases. The operating frequency of the cavity is a function of the cavity's dimensions. As temperature and the volume of the cavity increases, the operating frequency of the cavity decreases. In practice, resonant cavities of filters are constructed from relatively expensive temperature-stable materials such as INVAR nickel steel alloy (hereinafter referred to as "Invar"). However, the use of such materials has not resulted in a wholly acceptable solution to frequency shift. For example, at 12 GHz, it has been found that an Invar cavity shifts 0.9 MHz over a typical operating temperature range for communications satellites. In some applications, a shift of that magnitude is excessive and causes performance to be compromised. For filters used in output multiplexers of communication satellites, a complex and expensive thermal control system is utilized to control the temperature of the cavities making up the filters so that temperature changes can be kept within an acceptable range. When a thermal control system is provided, in addition to the cost of constructing the system, additional power must be made available on the satellite to operate the system. Also, the volume and mass of the thermal control system add greatly to the overall cost of constructing and launching the satellite.

Invar is a relatively heavy material and the use of Invar is therefore disadvantageous where payload weight is an important factor. In addition, Invar has a low level of thermal conductivity. In high power communication satellites, a substantial amount of heat must be dissipated and a thermal control system is necessary on communication satellites to control the temperature of the Invar cavities making up the filters of output multiplexers.

Thus, substantial cost savings can be achieved, even if Invar was continued to be used, by eliminating the thermal control system. Further, if a less expensive or lighter material or a material having a higher degree of thermal conductivity than Invar can be used, further cost savings can be achieved. Temperature compensated filters are known as indicated by the following discussion of references. However, previous filters are much too complex to design or construct; or, the level of temperature compensation available cannot be adjusted after the cavity is constructed; or, they are extremely expensive; or, the temperature compensation features are not sufficiently predictable or repeatable from cavity to cavity; or, the losses are unacceptably high; or, the filters resonate in a single mode.

The Collins U.S. Pat. No. 4,488,132 issued Dec. 11, 1984 describes a temperature compensated resonant cavity where the cavity has a bi-metal or tri-metal end cap so that the end caps expand into or out of the cavity to compensate for the increase or decrease in length of the cavity walls due to variations in temperature. Canadian Patent No. 1,257,349 issued Jul. 11, 1989 granted to Hughes Aircraft Company describes a temperature compensated microwave resonator having a cavity containing a temperature compensating structure that expands or contracts with temperature to minimize the resonant frequency change which would otherwise be caused by the change in volume of the cavity as temperature changes. The Lund, Jr., et al. U.S. Pat. No. 4,287,495 issued Sep. 1, 1981 describes a temperature compensated waveguide where the waveguide is made of a composite material having a plurality of successive plies where one ply has its fiber content aligned parallel to the longitudinal dimension and a second ply has its fiber content aligned parallel to the transverse dimension while third and fourth plies have their fiber content oriented at selected angles relative to the longitudinal dimension such that, as temperature changes, the transverse dimension of the waveguide changes by a sufficient amount to compensate for the change in the longitudinal dimension. The materials suggested are graphite epoxy laminates where the graphite has a negative coefficient of thermal expansion and the epoxy has a positive coefficient of thermal expansion. The cost of a waveguide cavity made from a composite material can be more than ten times the cost of a cavity made from Invar. In all three of the foregoing patents, the design considerations are highly complex. Also, it is sometimes difficult to repeat the thermal compensation results obtained by one cavity with subsequent cavities. Further, when these cavities are constructed, a certain level of temperature compensation is achieved but it cannot be subsequently varied without opening up the cavity and making structural changes to the cavity.

The Bernhard, et al. German Patent No. 2,740,294, disclosed on Mar. 8, 1979, describes a three cavity single mode filter where each cavity has a pin made of NDK ceramic with a negative temperature coefficient. The depth of insertion of each pin into the cavity resonator can be adjusted. The ceramic material is one type of dielectric material and can have a negative or positive temperature coefficient of the dielectric constant.

The Leger, et al. German Patent No. 3,326,830 was disclosed on Feb. 14, 1985 and describes a waveguide circuit which uses a dielectric body having a temperature dependent dielectric constant inserted into a resonator. The patent states that it is possible to compensate the temperature-dependent frequency-response characteristics of a filter using the device. The resonator is a single mode resonator.

The Kell, et al. U.K. Patent No. 1,268,811 was published on Mar. 29, 1972 and describes a microwave device that incorporates a dielectric material that is adjustably mounted within a hole in a dielectric resonator disc so that a frequency of the disc can be adjusted. The dielectric material can be a ceramic and is stated to have a permittivity in the range of 25 to 75. The preferred temperature coefficient of permittivity of the dielectric material is stated in the patent to be in the range from +50 to −100 ppm/°C. The drawings describe a single mode dielectric resonator bandpass filter having five dielectric discs where the dielectric discs are operated at the resonant frequency of the filter.

SUMMARY OF THE INVENTION

It is an object of the present invention to provide a simple and relatively inexpensive multi-mode filter where the level of temperature compensation achieved would allow the thermal control system for output multiplexers on a satellite to be entirely eliminated or where the cavities can be made of material that is much less expensive, much lighter and has a much higher thermal conductivity than Invar, which is used presently.

A microwave filter is provided having an input and an output and a first cavity made of a material having a coefficient of thermal expansion. The cavity resonates at an operating frequency in two orthogonal modes simultaneously. The cavity has a volume that is changeable with temperature and contains a solid dielectric material having a dielectric constant that varies with temperature, said dielectric material being sized so that it does not resonate at the operating frequency of the cavity. There is at least one amount of dielectric material having a value of a temperature coefficient of the dielectric constant to compensate for changes in the volume of the cavity with temperature to at least reduce a variation in said operating frequency that would otherwise be caused by a temperature-induced change of said cavity.

A method of constructing and compensating a microwave filter uses a first cavity resonating at an operating frequency in two orthogonal modes substantially simultaneously. The cavity is made of a material having a coefficient of thermal expansion and a volume that changes with temperature. The method includes selecting one amount and type of dielectric material to be contained within said cavity for each mode and selecting the amount of dielectric material so that the dielectric material does not resonate at the operating frequency of the cavity. The method includes selecting the dielectric material with a dielectric constant and a temperature coefficient of the dielectric constant to compensate for changes in volume of the cavity with temperature to at least reduce a variation in said operating frequency that would otherwise be caused by a temperature-induced volume change of said cavity.

DESCRIPTION OF A PREFERRED EMBODIMENT

Figure 1:
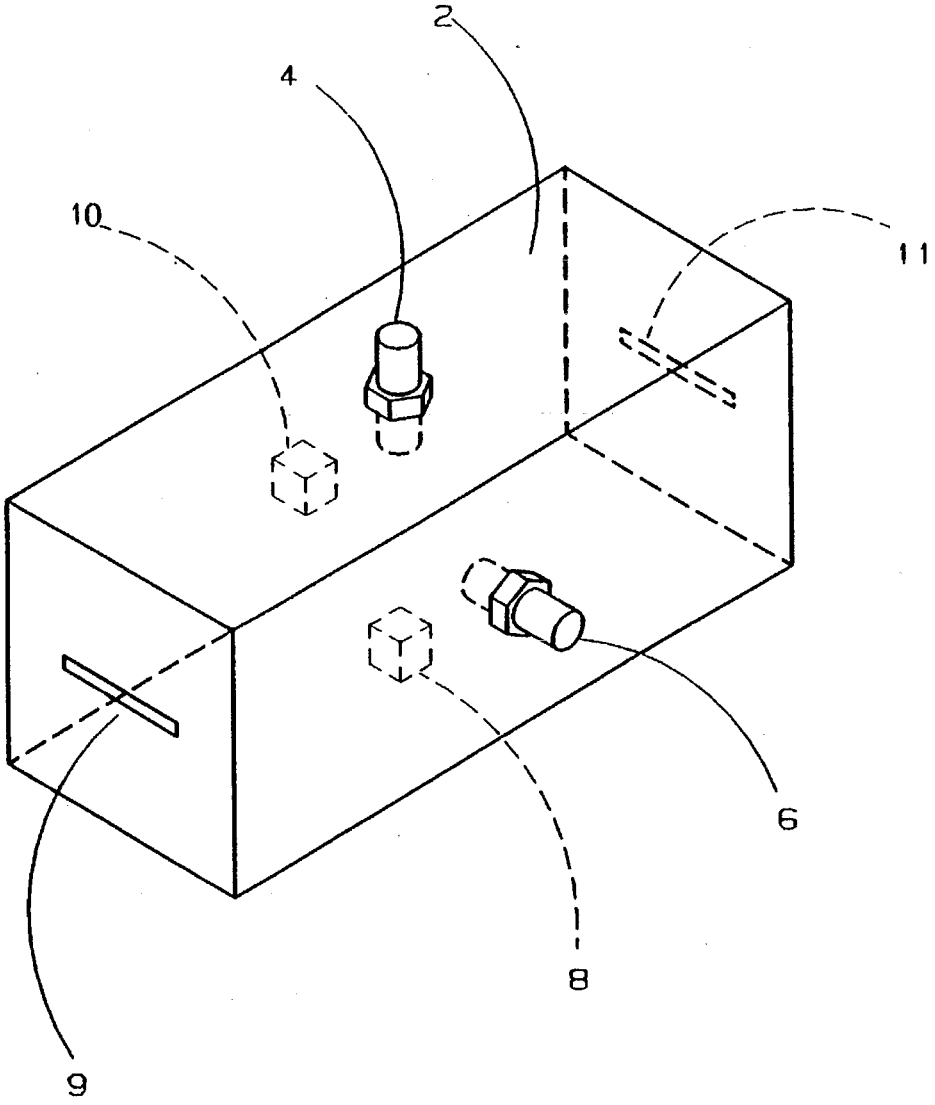
FIG. 1 is a perspective view of a dual mode $TE_{101}$ rectangular waveguide cavity containing one piece of dielectric material for each mode.

In FIG. 1, a filter has a dual-mode rectangular cavity 2 has two tuning screws 4, 6 and two amounts 8, 10 of dielectric material. There is one tuning screw and one amount of dielectric material for each mode. The cavity 2 has an input 9 and an output 11. The cavity can be made to resonate in a $TE_{101}$ mode. The dielectric material 8, 10 is sized so that it will not resonate at the resonant frequency of the cavity 2. The dielectric material can be located in the cavity in any suitable manner including using an appropriate adhesive. Each amount of dielectric material is preferably located at a maximum E-field location for the particular mode to which that dielectric material relates.

Figure 2A:
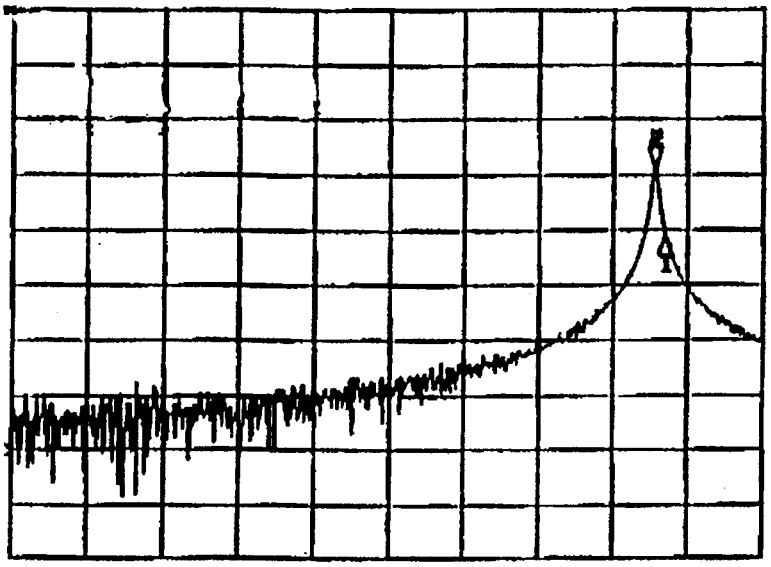
FIG. 2*a* is a graph of a frequency of one mode of a dual mode cavity.
Figure 2B:
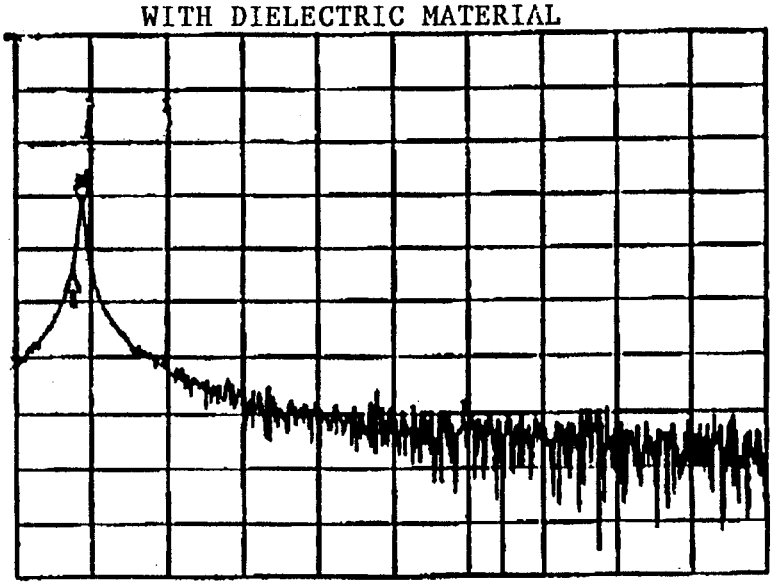
FIG. 2*b* is a graph of a frequency of the same mode of a dual mode cavity when dielectric material is present in the cavity of FIG. 1.

In FIG. 2*a*, the frequency of one mode of the cavity 2 is shown when there is no dielectric material present in the cavity. In FIG. 2*b*, the frequency of one mode of the cavity 2 is shown when there is dielectric material located in the cavity to shift the frequency of that mode. It can be seen that an operating frequency of the cavity shifts from 10.656 GHz when there is no dielectric material to 10.426 GHz when there is dielectric material present within the cavity.

Figure 3:
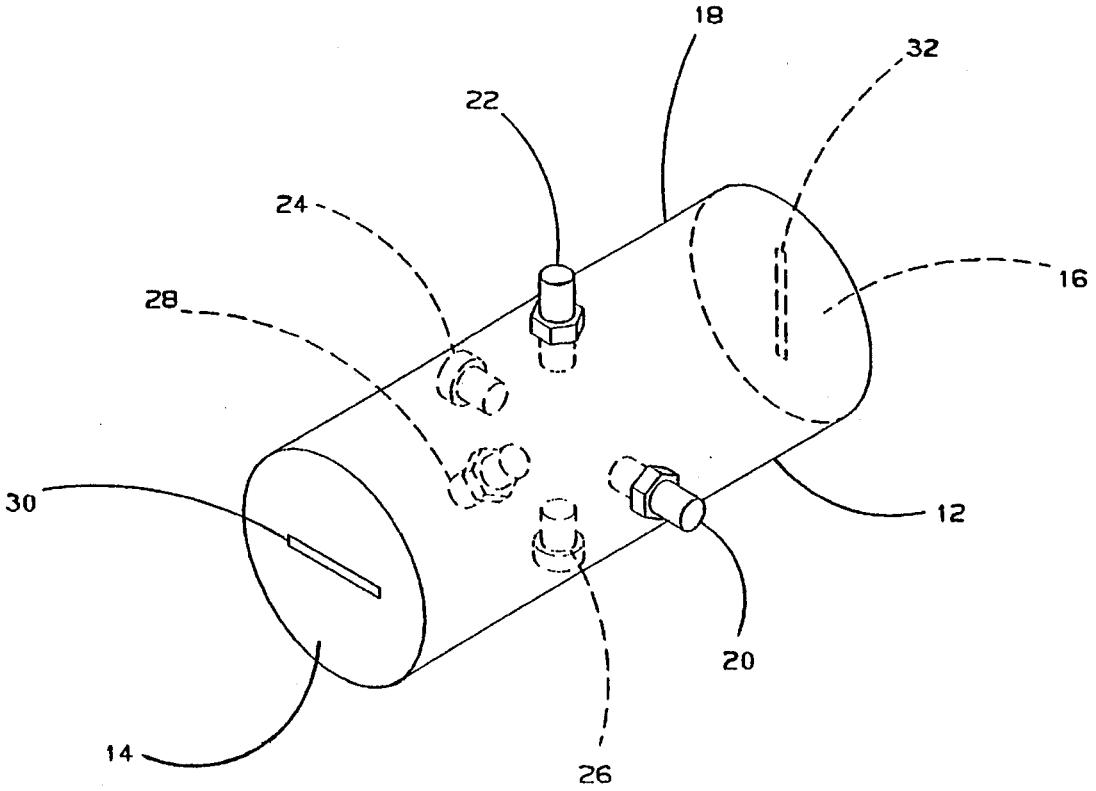
FIG. 3 is a perspective view of a dual mode $TE_{111}$ cylindrical cavity in which dielectric material is located in wall-mounted screws that are in the same plane as tuning screws.

In FIG. 3, a filter has a cylindrical cavity 12 that resonates in two $TE_{111}$ modes that are orthogonal to one another. The cavity 12 has two end walls 14, 16 and a curved side wall 18. In the side wall 18, in a circular plane, that is normal to a longitudinal axis of the cavity, midway between the end walls 14, 16, there are located tuning screws 20, 22, dielectric screws 24, 26 and coupling screw 28. When the term "dielectric screw" is used in this application, it shall mean a screw in which dielectric material is mounted. The tuning screws 20, 22 are 90° apart from one another. The tuning screw 20 and the dielectric screw 24 primarily relate to the first mode and are 180° apart from one another. The tuning screw 22 and the dielectric screw 26 primarily relate to the second mode and are 180° apart from one another. The coupling screw 28 is located at a 45° angle relative to the dielectric screws 24, 26. The particular arrangement of the tuning, coupling and dielectric screws will vary with the shape of the cavity and the dominant modes being propagated within the cavity. Preferably, the cavity 12 has an input 30 and output 32. Various input and output arrangements, including probes and irises can be utilized. The coupling screw 28 can be omitted if it was not desired to couple energy between the two modes resonating within the cavity. Similarly, the tuning screws can be omitted in certain applications. If desired, the location of the tuning screw 20 and the dielectric screw 24 could be reversed and the location of the tuning screw 22 and the dielectric screw 26 could be reversed so that the coupling screw was located at a 45° angle relative to the tuning screws 20, 22. Similarly, the tuning screws 20, 22 and dielectric screws 24, 28 could be left in the positions shown in FIG. 3 and the coupling screw 28 could be relocated by 180° so that the coupling screw 28 was located at a 45° angle relative to the tuning screws 20, 22.

Whenever two dielectric screws (or two amounts of dielectric material) are used in a dual-mode cavity to shift the frequency of a particular mode, one dielectric screw (or one amount of dielectric material) will have a dominant effect on the frequency of the mode to which it relates and a lesser effect on the other mode. In other words, a dielectric screw relating to a first mode will have a dominant effect on or will primarily affect the first mode and will also affect the frequency shift of a second mode to a lesser extent. Similarly, a dielectric screw relating to the second mode will have a dominant effect on or will primarily affect the second mode and will also affect the first mode to a lesser extent. Any susceptance can be used to support the dielectric material within the cavity so that the amount of dielectric material can be varied externally.

Figure 4:
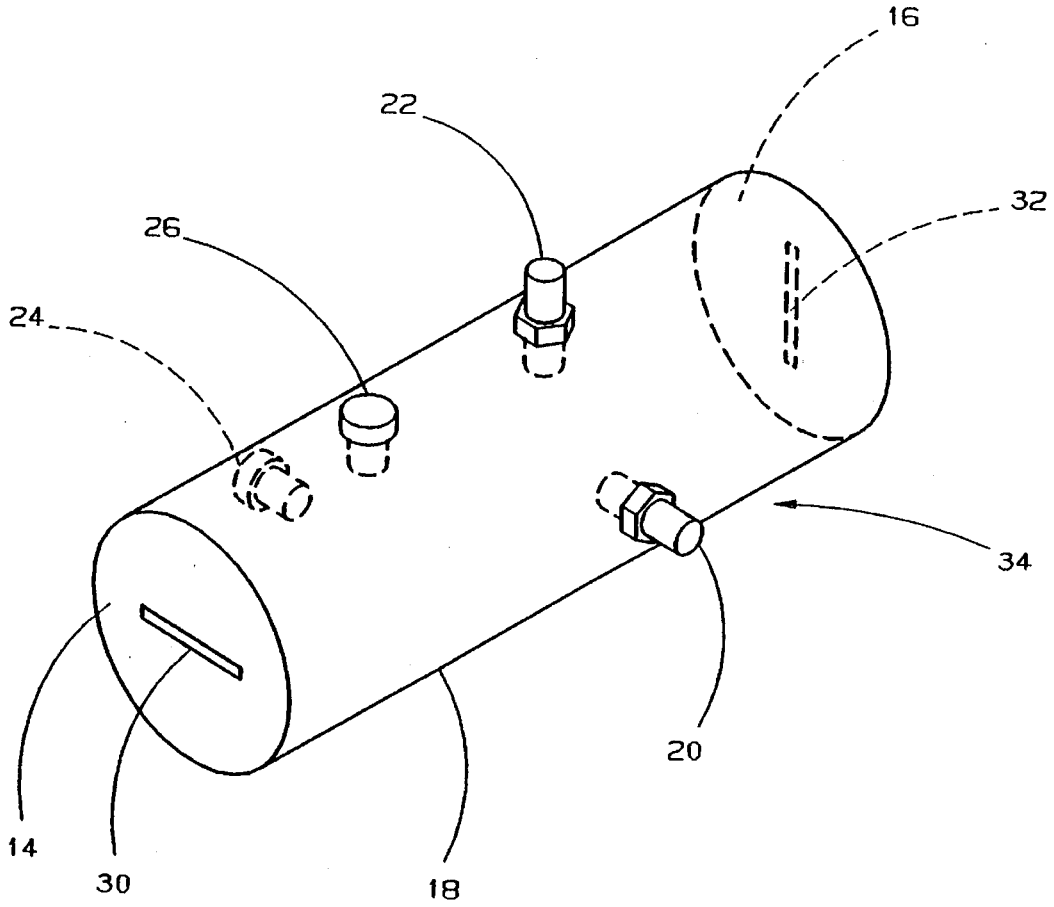
FIG. 4 is a perspective view of a dual mode $TE_{113}$ cylindrical waveguide cavity where dielectric material is located in wall-mounted screws located between the tuning screws and an end wall of the cavity.

In FIG. 4, a filter has a $TE_{113}$ cavity 34 with tuning screws 20, 22 and dielectric screws 24, 26 located in the side wall 18 of the cavity between the end walls 14, 16. The tuning screws 20, 22 are located in a circular plane, normal to a longitudinal axis of the cavity 34, one-half of the distance between the end walls 14, 16. The dielectric screws 24, 26 are located in a circular plane normal to the longitudinal axis of the cavity 34 one-quarter of the distance between the end walls 14, 16, and closer to the end wall 14. The screws 20, 24 relate to the first mode and the screws 22, 26 relate to the second mode. The dielectric screws 24, 26 are located at the maximum E-field location of each mode. If desired, the location of the tuning screws and dielectric screws can be reversed.

Figure 5:
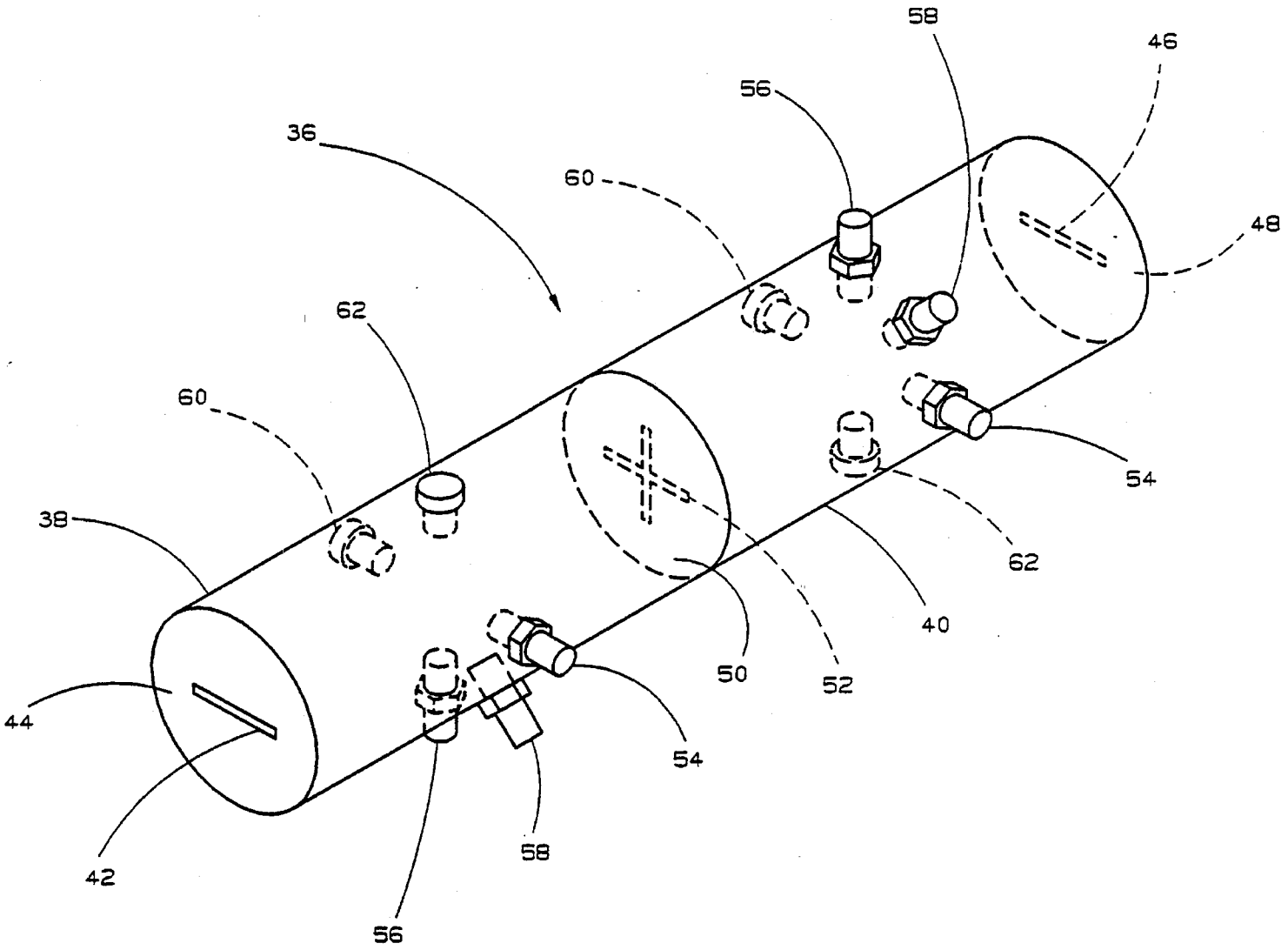
FIG. 5 is a perspective view of a dual mode four-pole filter where each cavity contains dielectric material located in wall-mounted screws.

In FIG. 5, there is shown a dual-mode $TE_{111}$ four-pole filter 36 having two cylindrical cavities 38, 40 mounted coaxially to one another. The cavity 38 has an input slot 42 in an end wall 44 to couple energy into the filter 36. The cavity 40 has an output slot 46 in an end wall 48 to couple energy out of the filter 36. An iris 50 contains a cruciform aperture 52 to couple energy between the cavities 38, 40. Each cavity 38, 40 has two tuning screws 54, 56 and one coupling screw 58. Each cavity 38, 40 has two dielectric screws 60, 62. The screws 54, 60 affect the first $TE_{111}$ mode and the screws 56, 62 affect the second $TE_{111}$ mode. The $TE_{111}$ modes are orthogonal to one another. It should be noted that the screws of the cavity 40 are shifted by 90° relative to the screws of the cavity 38. The location of the screws is a preferred orientation. Various other orientations can be utilized to provide the same result.

Figure 6:
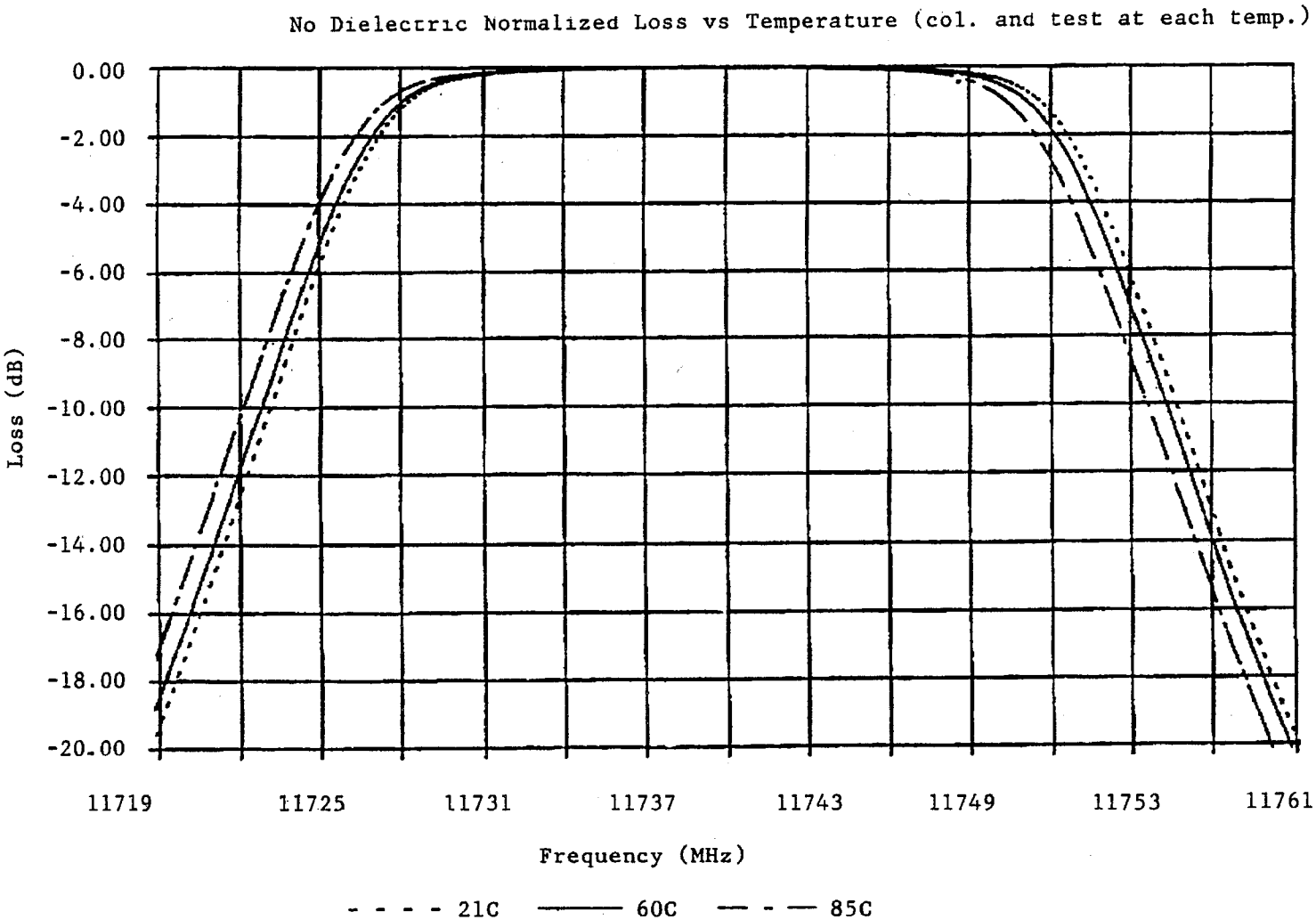
FIG. 6 is a graph showing the temperature stability of a filter that is virtually identical to the filter of FIG. 5 except that is not temperature compensated.

In FIG. 6, there is shown a graph of the loss versus frequency for a prior art version of the filter 36 (which is identical to the filter 36 except that the dielectric screws 60, 62 have been omitted). The prior art version is not shown but, from FIG. 6, it can be seen that the frequency varies as temperature increases. The temperature stability of the prior art filter (not shown in the drawings) from 21° C. to 85° C. is approximately 2.0 ppm/°C.

Figure 7:
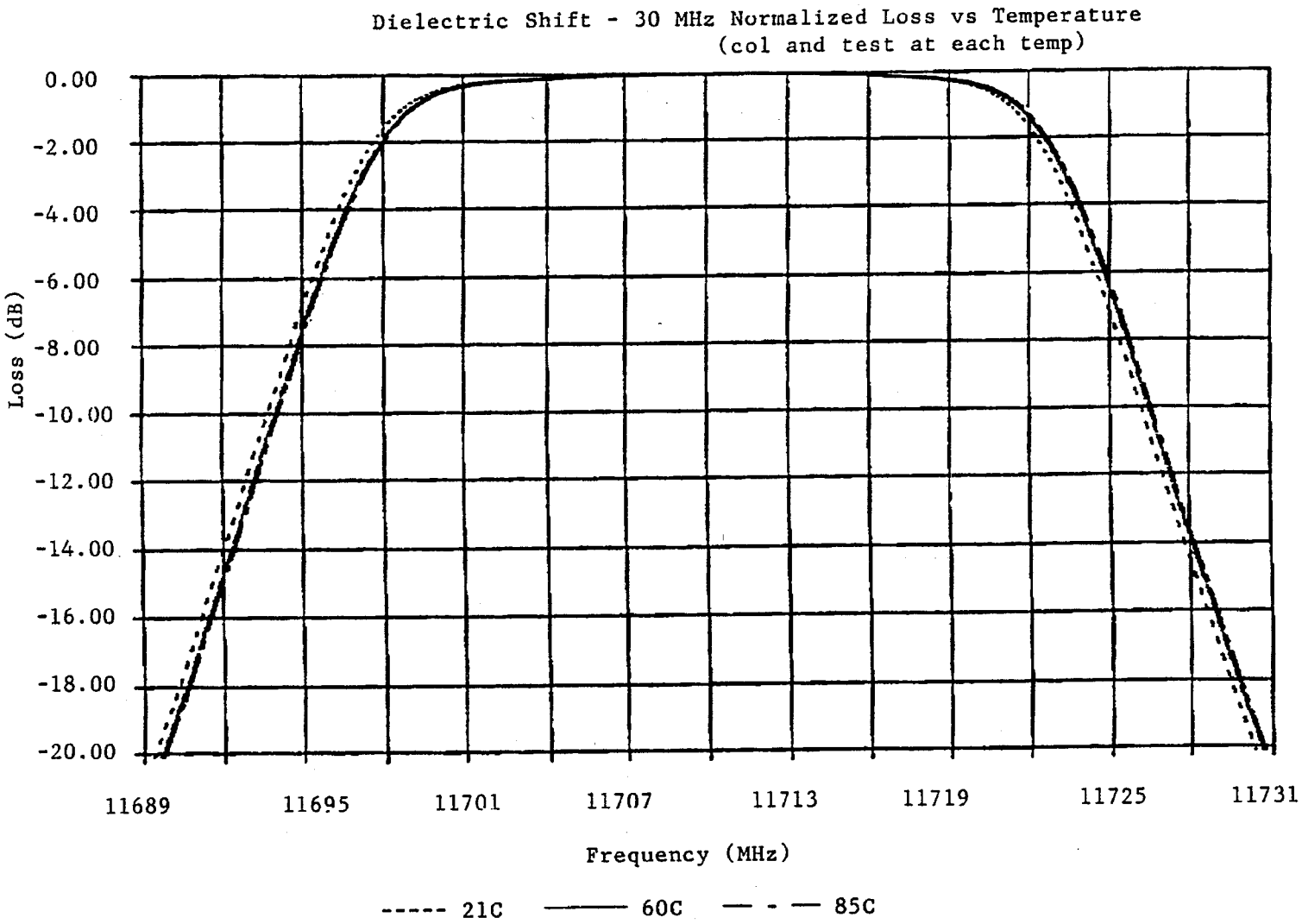
FIG. 7 is a graph showing the temperature stability of the filter of FIG. 5.

In FIG. 7, a graph of loss versus frequency at various temperatures is shown for the filter 36. It can be seen that the variation of frequency with temperature is greatly reduced and, in fact, the filter 36 is over compensated and the temperature stability is −0.8 ppm/°C. The temperature stability of the filter 36 can thus be improved by turning the dielectric screws 60, 62 slightly outward and taking further stability measurements at the three temperatures to plot a new graph similar to that shown in FIG. 7 until the temperature stability of the filter is substantially equal to 0 ppm/°C. Thus, adjustment of the dielectric screws 60, 62 for filters constructed in accordance with the present invention results in an adjustment to the temperature stability of the filter.

Figure 8:
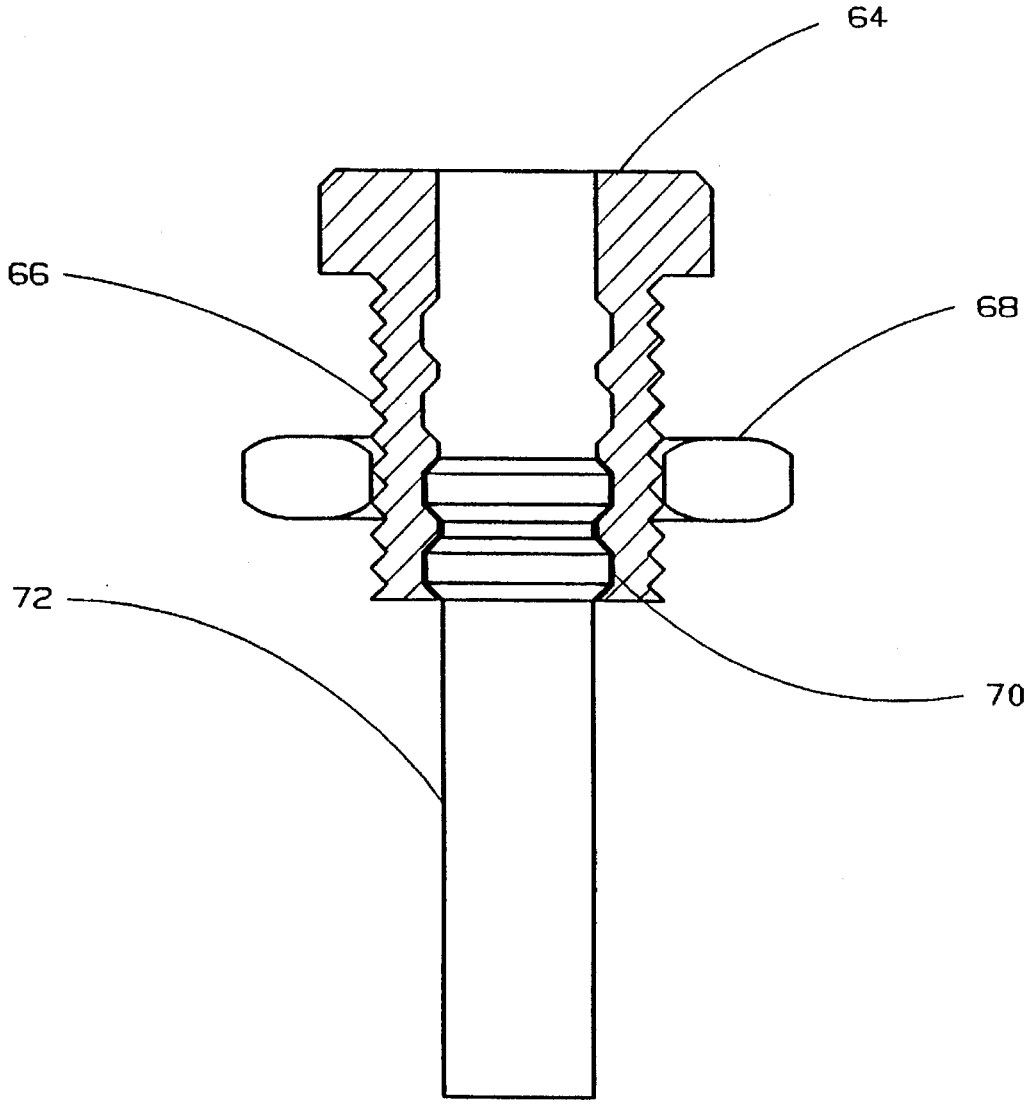
FIG. 8 is a partial sectional view of a preferred self-locking screw containing dielectric material.

In FIG. 8, there is shown a cross-sectional view of a JOHANSON (a trade mark) self-locking screw which is a preferred dielectric screw for the purposes of the present invention. The screw 64 has a bushing 66, a hexnut 68 threaded to an outer surface of said bushing 66 and a rotor 70. The screw 64 is conventional and is most often used as a tuning screw. The screw 64 can have dielectric material 72 mounted on the rotor 70. Any tuning or coupling screw will be suitable for the dielectric screws of the present invention so long as the screw has an appropriate locking mechanism to lock the screw in a particular position. It is not essential that the dielectric screws be self-locking.

Figure 9:
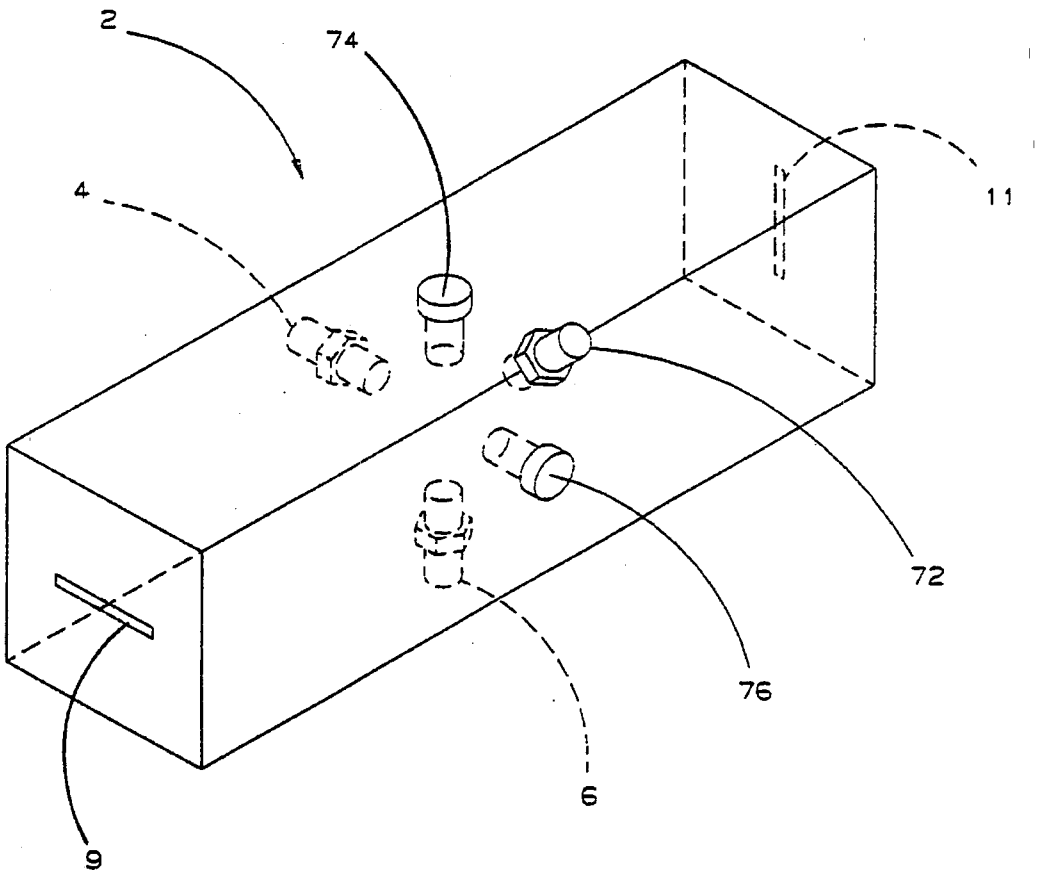
FIG. 9 is a perspective view of a rectangular dual-mode $TE_{101}$ cavity where dielectric material is located in wall mounted screws.

In FIG. 9, a rectangular cavity 2 is virtually the same as the cavity 2 of FIG. 1 except that it has a coupling screw 72 and two dielectric screws 74, 76 so that the amount of dielectric material contained within the cavity for each mode can be adjusted after the cavity is constructed. In FIG. 1, the dielectric material was held in the cavity by adhesive. The input and output to the cavity have been omitted.

Figure 10:
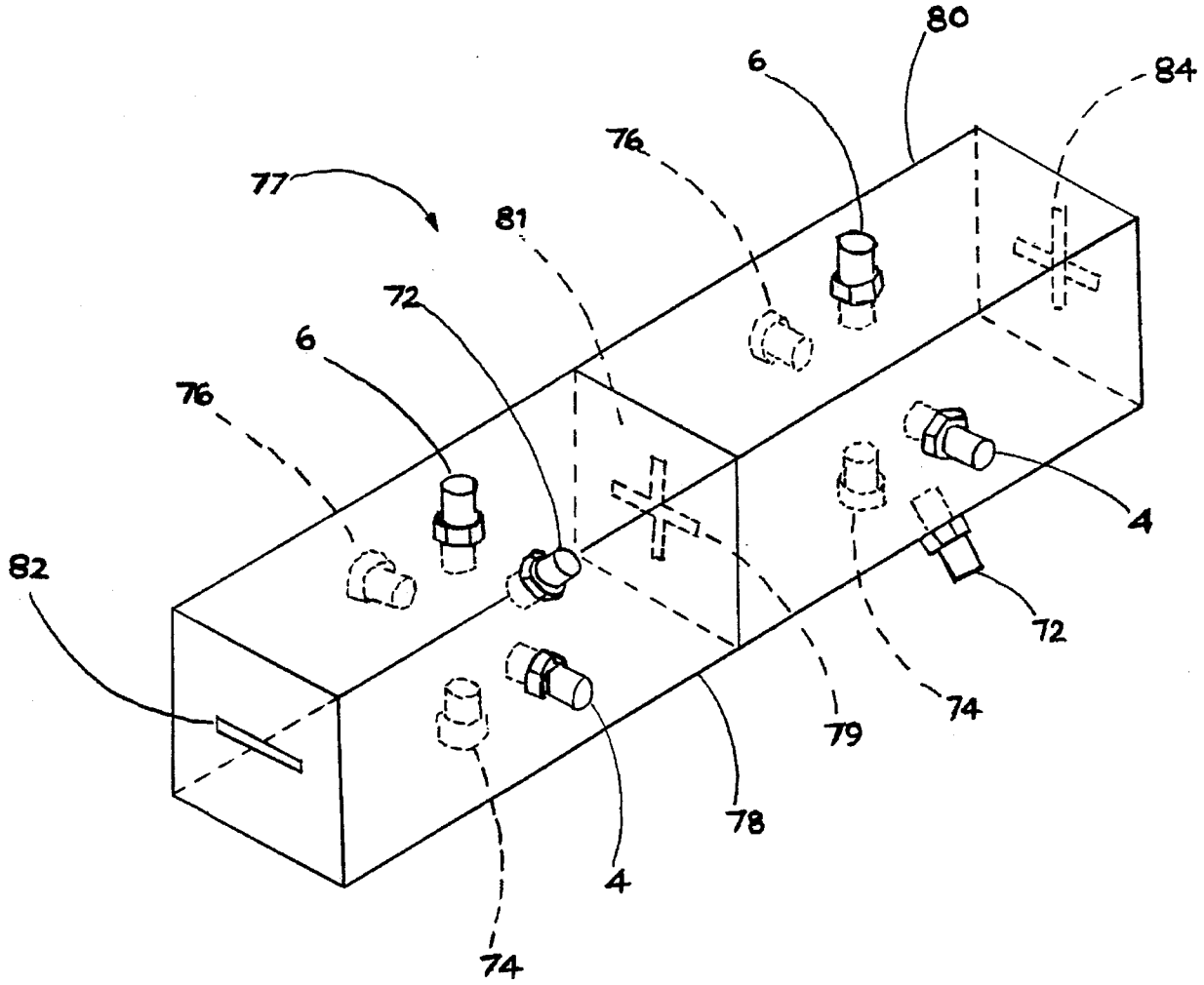
FIG. 10 is a perspective view of a dual-mode four-pole planar filter with rectangular cavities where dielectric material is mounted in said cavities.

In FIG. 10, there is shown a four-pole dual-mode rectangular filter 77 having two cavities 78, 80. The filter has an input 82 in cavity 78 and an output 84 in cavity 80. The tuning screws 4, 6, coupling screw 72 and dielectric screws 74, 76 of each cavity are oriented in a similar manner to the screws of the cavity 2 shown in FIG. 9 and the same reference numerals are used. Coupling between the cavities 78, 80 is controlled by aperture 79 in iris 81.

Figure 11:
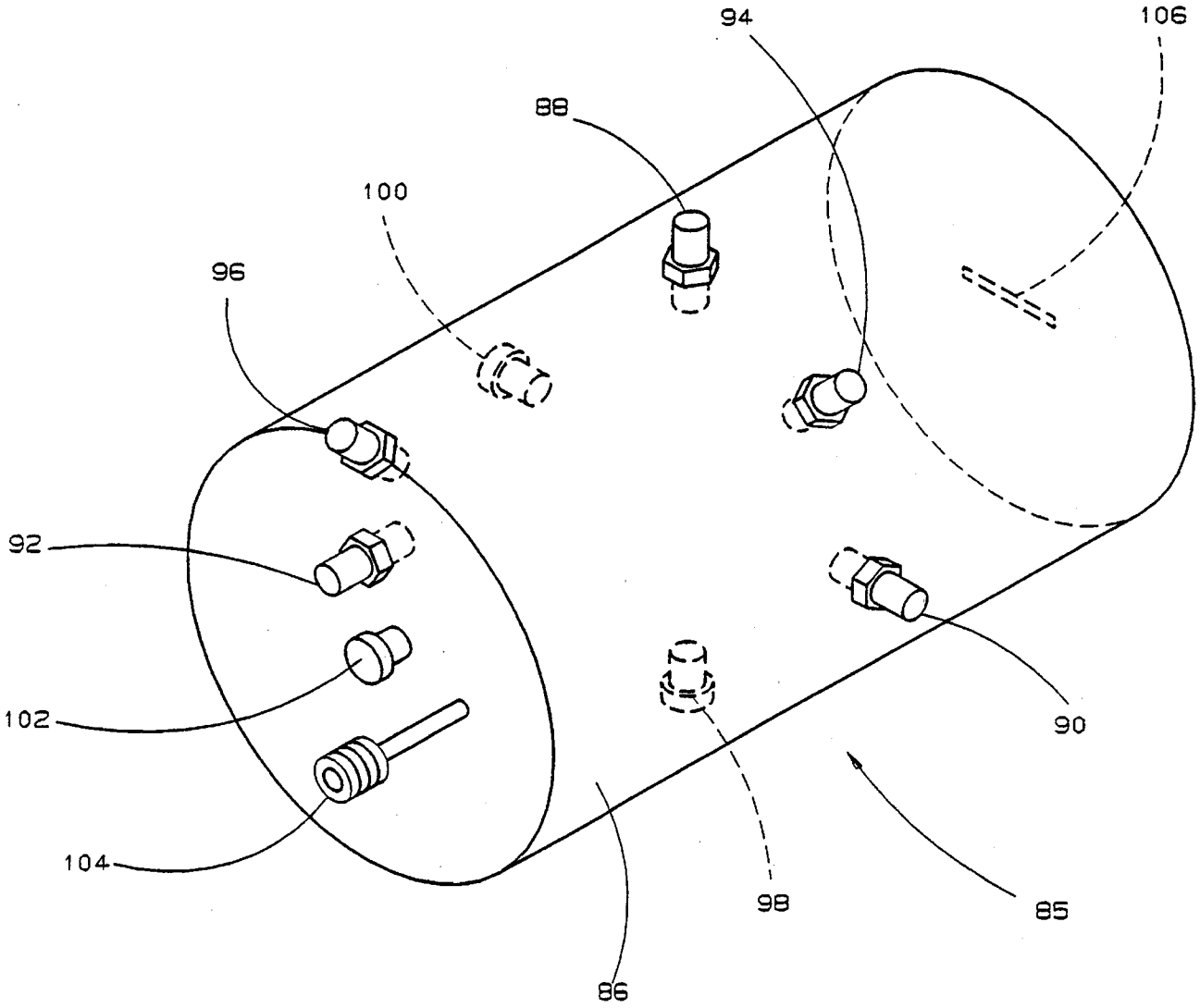
FIG. 11 is a perspective view of a triple-mode cavity where dielectric material is located in wall mounted screws.

In FIG. 11, there is shown a triple-mode filter 85 having a cavity 86 and three tuning screws 88, 90, 92 and two coupling screws 94, 96. The tuning screws 88, 90, 92 tune the first mode, second mode and third mode respectively. Typically, the triple mode filter will be made to resonate in two $TE_{111}$ modes and one $TM_{010}$ mode but other modes are feasible as well. Also, the cavity could have a square cross-section or other suitable shape. Coupling screw 94 couples energy between the first mode and the second mode and coupling screw 96 couples energy between the second mode and the third mode. Dielectric screws 98, 100, 102 couple energy and affect the first mode, second mode and third mode respectively. The cavity 86 has an input 104 and an output 106. As with dual-mode cavities having two dielectric screws, the dielectric screw 98 for the first mode dominates the frequency shift for the first mode but also has an effect on the frequency shift for the second and third modes. The dielectric screws 100, 102 act in a similar manner to the screw 98 except that the dominant effect is on the second and third modes respectively.

Figure 12:
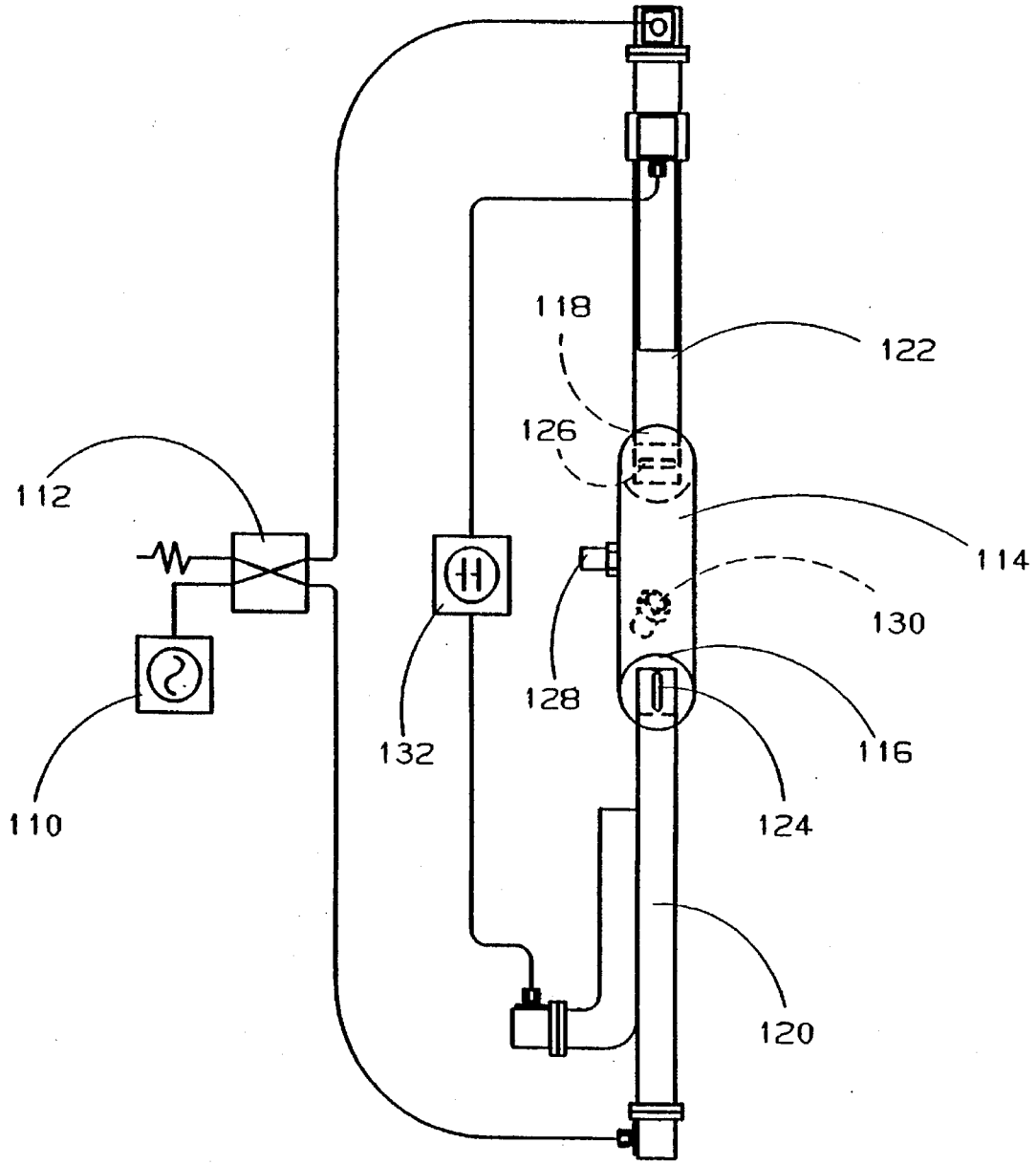
FIG. 12 is a schematic view of a cavity and circuit diagram for adjusting an amount of dielectric material in the cavity for each mode.

In FIG. 12, it can be seen that a frequency generator 110 is connected into a three dB power divider 112 to simultaneously excite a mode into a dual-mode cavity 114 having two ends 116, 118. One mode is excited into each of the ends 116, 118 through directional couplers 120, 122 connected to inputs 124, 126 respectively. The inputs 124, 126 are rotated 90° relative to one another so that each mode is rotated 90° relative to one another. The cavity 114 has two dielectric screws 128, 130 that can be turned to vary the amount of dielectric material within the cavity. The directional couplers 120, 122 are also rotated 90° from one another and are connected to a dual channel network analyzer 132.

It is important in multi-mode operation that the amount of dielectric material in the cavity for each mode is exactly the same. If the amount differs, over temperature, the resonant frequency of the two modes will diverge as temperature increases. It is difficult to fix the amount of dielectric material exactly the same for each mode because it is difficult to measure the exact amount of material inside the cavity. Also, while it is possible to measure a penetration level of the dielectric material, the accumulation tolerance from the screw location, the perpendicularity of the screw and the effect of the locking of the screw will affect the tolerance since the adjustment of each dielectric screw affects the frequency shift of both modes. It is therefore very difficult, if not impossible to independently set the frequency shift (i.e. $\Delta_f$) of both modes. With a single mode filter having two cavities, the first mode is in a separate cavity from the second mode and the two modes are independent of one another.

When two modes are excited simultaneously within a cavity but are rotated 90° from one another, each mode will short circuit and a resonance peak from reflection can be detected by the directional coupler for that particular mode. The directional coupler feeds into the dual channel network analyzer. One or both of the dielectric screws 128, 130 in the cavity can then be adjusted until the network analyzer indicates that the two reflection peaks are at the same frequency. When the two reflection peaks are at the same frequency, a volume or amount of dielectric material inside the dual-mode cavity will be the same for each mode. The system can easily be varied for use with triple mode filters.

The filters of the present invention can be formed from a variety of conductive materials including Invar, aluminum, aluminum alloys, graphite composites and metal composites. Invar is the most commonly used material at the present time.

Invar has a coefficient of thermal expansion of 1.6 ppm/°C. before plating with silver and 2 ppm/°C. after plating. However, Invar is approximately three times heavier than aluminum. Thus, a significant weight penalty is associated with the performance gain that is obtainable through the use of Invar. Graphite epoxy composites can achieve a coefficient of thermal expansion close to 0 ppm/°C. and this material is lighter than aluminum. However, graphite epoxy composite cavities are far more difficult to manufacture and control and cavities made from composite materials are approximately 10 times more expensive than Invar cavities and more than 20 times more expensive than aluminum cavities. Graphite composite cavities also have a serious limitation at high temperature operation beyond 100° C. as the epoxy joints begin to soften. The coefficient of thermal expansion of aluminum is 23.4 ppm/°C. The temperature stability of a cavity varies with the coefficient of thermal expansion of the material from which the cavity is made and the operating frequency of the cavity. For example, for a plated Invar cavity having an operating frequency of 12 GHz, the temperature stability of the cavity would be 2.0×12,000 Hz/°C. or 24,000 Hz/°C.

When one amount of dielectric material is inserted into a cavity for each mode in which the cavity resonates and the dielectric material is preferably located at the maximum E-field for a given mode, the operating frequency of the cavity will shift downward when the dielectric material is inserted into a cavity. The frequency shifts downward because the dielectric constant is greater than 1 and the amount of shifting is a function of the dielectric constant. The higher the dielectric constant, the larger the frequency shift. If the material from which the cavity is made has a positive coefficient of thermal expansion (i.e. the material expands with temperature) and the dielectric constant has a negative temperature coefficient (i.e. the dielectric constant decreases with temperature) then, as temperature increases, a volume of the cavity will also increase slightly and the operating frequency of the cavity will decrease slightly. The presence of the dielectric material for each mode causes the operating frequency of the cavity to decrease slightly. Thus, at a temperature $T_1$, the cavity will have an operating frequency $F_0$. As temperature increases to $T_2$, the volume of the cavity will increase and the operating frequency will tend to decrease. However, the tendency of the operating frequency to decrease due to the expansion of the cavity will be offset by the presence of the dielectric material. The higher the dielectric constant of the dielectric material the greater that the operating frequency of the cavity will shift downward. Since the dielectric constant of the dielectric material has a negative temperature coefficient, the dielectric constant decreases as temperature increases. As the dielectric constant decreases, the shift in frequency is lessened. In other words, the frequency of the cavity will tend to increase with temperature as the dielectric constant decreases.

The larger the amount of dielectric material within the cavity in relation to a particular mode, the greater the shift in the operating frequency. Preferably, the dielectric material has a high Q, a high dielectric constant and the dielectric constant has a negative temperature coefficient. For example, the Q is preferably greater than 1000, the dielectric constant is preferably greater than 30 and the negative temperature coefficient of the dielectric constant is preferably greater than 200 ppm/°C. When the coefficient of thermal expansion of the material, from which the cavity is made, is positive, the temperature coefficient of the dielectric constant is preferably greater than −200 ppm/°C. Still more preferably, the Q is greater than 4000, the dielectric constant is greater than 80 and the temperature coefficient of the dielectric constant is greater than ±400 ppm/°C. By choosing a suitable dielectric material, a cavity can be constructed where the temperature stability of the material from which the cavity is made is approximately equal to the temperature stability caused by the dielectric material. The temperature stability caused by the dielectric material can be adjusted after the cavity is made by varying the amount of the material in the cavity, as required. The shift in frequency over temperature caused by the dielectric material varies with the size of the negative temperature coefficient for the dielectric constant and the amount of dielectric material in the cavity in relation to a particular mode.

For a frequency shift of 25 MHz and a negative temperature coefficient for the dielectric constant of −600 ppm/°C., the temperature shift caused by the dielectric material is 25×−600 Hz/°C.×$\sqrt{n}$ or −25,500 Hz/°C., where n is the third mode index of the cavity resonator. For the $TE_{113}$ mode, n is equal to 3. This equation is approximate only but one can determine that if the temperature stability of the cavity is balanced by the negative temperature stability caused by the dielectric material, the operating frequency of the filter will remain substantially constant with temperature. The higher the dielectric constant of the dielectric material, the greater the frequency shift.

In theory, a particular cavity is perfectly compensated for temperature when the temperature stability of the cavity is exactly balanced by the temperature stability of the dielectric material. While a typical cavity will have a positive coefficient of thermal expansion, it is possible to construct a cavity having a negative coefficient of thermal expansion and then use a dielectric material having a positive temperature coefficient of the dielectric constant. Further, a filter having more than one cavity can be compensated for temperature by designing one cavity to have a positive temperature stability which is balanced by a negative temperature stability for the other cavity or cavities.

In practice, it may not be cost effective to achieve perfect temperature compensation for a cavity or for a filter. For practical purposes, in most uses where the temperature stability of the filter is less than 1 ppm/°C. or more preferably, less than ½ ppm/°C., that result would be sufficient to eliminate the thermal control system on a satellite for the output multiplexers. When the temperature stability of the filter is equal to 0 ppm/°C., the frequency shift caused by the increase in volume of the cavity or cavities of the filter with temperature is exactly balanced by the frequency shift of the cavity or cavities of the filter with temperature (caused by the change in the dielectric constant), thereby keeping the operating frequency of the filter constant with changes in temperature. While the dielectric material will typically expand in volume with temperature, that expansion is insignificant when compared to the effect of the dielectric constant with temperature for two reasons: firstly, the amount of the dielectric material is relatively small and any change in volume with temperature is much smaller still; secondly, a coefficient of thermal expansion for dielectric material is typically very small as well. When the method of the present invention is followed, any volume changes of the dielectric material with temperature are necessarily taken into account in determining the temperature stability of the filter.

One advantage of filters having an adjustable amount of dielectric material in accordance with the present invention is that in addition to varying the amount of material within the cavity, the dielectric material itself can be changed to an entirely different material simply by removing the dielectric screw and switching the dielectric material mounted on the screw with another dielectric material. Preferably, the type of dielectric material used within a particular cavity will be identical for all of the modes. However, circumstances could arise where it might be desirable to use different dielectric materials for different modes within the same cavity.

A variety of different cavity configurations are available in filters of the present invention. For example, a cavity can be a dual-mode square cavity having a $TE_{10n}$ mode where n is a positive integer. Similarly, the cavity can be a dual-mode circular cavity resonating in a $TE_{11n}$ mode where n is a positive integer. Moreover, a filter can have one or more square cavities and one or more circular cavities. Square and circular cavities can be cascaded together in the same filter. A filter can also be provided with a coaxial arrangement of cavities or a planar arrangement of cavities. A cavity can be a triple-mode square or circular cavity.

A cavity can be made of various materials including Invar, aluminum, titanium, alloys including any or all of these metals, as well as composites. Composites can be graphite composites or metal composites, including aluminum silicon, aluminum beryllium and aluminum silicon carbide. The advantage of aluminum is that it is very inexpensive, lightweight and has a high level of thermal conductivity so that heat can be dissipated rapidly and a filter made from aluminum cavities can be operated at very high power levels without overheating. However, aluminum has a coefficient of thermal expansion of 23.4 ppm/°C. whereas an aluminum metal matrix which is 40% loaded with silicon (i.e. A40 [a trade mark]) has a coefficient of thermal expansion of 13 ppm/°C.

Various materials will be suitable as dielectric material. Dielectric material such as titanate based materials can have a temperature coefficient of the dielectric constant ranging from −1,400 to −500 ppm/°C. An example is D-100 Titania (a trade mark of TransTech) which has a Q of 1000, a dielectric constant of 96 and a negative temperature coefficient of the dielectric constant of −560 ppm/°C.

It has been found that the larger the frequency shift required to compensate the filter, the greater the losses will be. By choosing a dielectric material with a high Q, a high dielectric constant (greater than 80) and a ultrahigh coefficient of thermal expansion for the dielectric constant (greater than 500), the frequency shift and loss will be relatively small. When the shift in frequency is kept relatively small by the proper choice of dielectric material, the loss in the filter will be further decreased.

When filters, in accordance with the present invention, are to be operated under high power, the loss of the filter will increase as the dielectric material within the cavity heats up. Typically, when the filter is tested after construction, it will be tested with low power (i.e. isothermal conditions). With high power, the conditions will no longer be isothermal and the fact that the dielectric material will heat up during operation is another factor that should be taken into account when setting the degree of penetration of the dielectric material. If the dielectric material is retracted slightly, there will be less heat given off by the dielectric material and less loss.

While a great deal of work has been carried out relating to prior art temperature compensated cavities, none of these prior art systems have enjoyed widespread use in the satellite communication industry. In particular, the output multiplexer on a satellite, particularly in the Ku band, still generally utilizes filters having cavities made from Invar accompanied by a temperature control system. Variations within the scope of the attached claims will readily occur to those skilled in the art.

What I claim as my invention is:

1. A microwave filter comprising an input and output and a first cavity made of a material having a coefficient of thermal expansion and resonating at an operating frequency in at least two orthogonal modes substantially simultaneously, said cavity having a volume that is changeable with temperature, said cavity containing solid dielectric material having a dielectric constant that varies with temperature, said dielectric material being sized so that it does not resonate at the operating frequency of the cavity, there being at least one amount of said dielectric material having a value of a temperature coefficient of the dielectric constant to compensate for changes in the volume of the cavity with temperature to at least reduce a variation in said operating frequency that would otherwise by caused by a temperature-induced volume change of said cavity.

2. A filter as claimed in claim 1 wherein there are two amounts of dielectric material, one amount to primarily compensate for one mode and another amount to primarily compensate for another mode.

3. A filter as claimed in claim 2 wherein each amount of dielectric material is sized and located so that said operating frequency remains substantially constant as said temperature changes.

4. A filter as claimed in any one of claims 1, 2 or 3 wherein the volume of said first cavity increases as temperature increases and the dielectric constant of the dielectric material decreases as temperature increases.

5. A filter as claimed in any one of claims 1 or 2 wherein each amount of dielectric material is sized and located so that a change in said operating frequency of said filter is minimized.

6. A filter as claimed in claim 1 wherein said dielectric material is located at a maximum E-field location for at least one mode.

7. A filter as claimed in any one of claims 2 or 3 wherein one amount of dielectric material is located at a maximum E-field location for one mode and the other amount of dielectric material is located at a maximum E-field location for the other mode.

8. A filter as claimed in any one of claims 1, 2 or 3 wherein said dielectric material is mounted on an adjustable susceptance such that the amount of dielectric material within the first cavity can be varied externally.

9. A filter as claimed in any one of claims 1, 2 or 3 wherein each amount of dielectric material is mounted on a screw that penetrates a wall of said first cavity so that the amount of dielectric material within said first cavity can be varied externally.

10. A filter as claimed in any one of claims 1, 2 or 3 wherein the dielectric material is mounted in a self-locking screw that penetrates a wall of said first cavity so that the amount of dielectric material within the cavity can be varied externally.

11. A filter as claimed in any one of claims 1, 2 or 3 wherein said first cavity has at least one tuning screw to tune at least one of the modes.

12. A filter as claimed in any one of claims 1, 2 or 3 wherein said first cavity has a coupling screw to couple energy between said modes.

13. A filter as claimed in any one of claims 1, 2 or 3 wherein said first cavity has a square or rectangular cross-section and resonates in two $TE_{10n}$ modes, where n is a positive integer.

14. A filter as claimed in any one of claims 1, 2 or 3 wherein said first cavity has a circular cross-section and resonates in two $TE_{11n}$ modes, where n is a positive integer.

15. A filter as claimed in any one of claims 1, 2 or 3 wherein the filter has a second cavity and said second cavity contains dielectric material having a temperature coefficient of the dielectric constant to compensate for changes in temperature, there being means to couple energy between said first cavity and said second cavity.

16. A filter as claimed in any one of claims 1, 2 or 3 wherein the amount of dielectric material is relatively small compared to the size of the cavity.

17. A filter as claimed in any one of claims 1, 2 or 3 wherein the filter has more than one cavity and the cavities are mounted relative to one another in a coaxial configuration.

18. A filter as claimed in any one of claims 1, 2 or 3 wherein said first cavity resonates in three orthogonal modes substantially simultaneously.

19. A filter as claimed in any one of claims 1, 2 or 3 wherein said first cavity resonates in three orthogonal modes substantially simultaneously, said first cavity containing three amounts of dielectric material, one amount to primarily affect each mode.

20. A filter as claimed in any one of claims 1, 2 or 3 wherein said dielectric material has a dielectric constant greater than 30.

21. A filter as claimed in any one of claims 1, 2 or 3 wherein said dielectric constant has a temperature coefficient greater than –200 ppm/°C.

22. A filter as claimed in any one of claims 1, 2 or 3 wherein said dielectric material has a Q greater than 1000.

23. A filter as claimed in any one of claims 1, 2 or 3 wherein said dielectric material has a dielectric constant greater than 80.

24. A filter as claimed in any one of claims 1, 2 or 3 wherein said dielectric constant has a temperature coefficient greater than –400 ppm/°C.

25. A filter as claimed in any one of claims 1, 2 or 3 wherein said dielectric material has a Q greater than 4000.

26. A filter as claimed in any one of claims 1, 2 or 3 wherein the material from which the cavity is made is selected from the group of Invar, titanium, aluminum graphite composite, metal composite and aluminum alloy.

27. A filter as claimed in any one of claims 1, 2 or 3 wherein material from which the cavity is constructed is selected from the group of aluminum silicon, aluminum beryllium and aluminum silicon carbide.

28. A filter as claimed in any one of claims 1, 2 or 3 wherein a temperature stability of the filter does not exceed 1 ppm/°C.

29. A filter as claimed in any one of claims 1, 2 or 3 wherein a temperature stability of the filter does not exceed ½ ppm/°C.

30. A filter as claimed in any one of claims 1, 2 or 3 wherein the filter has more than one cavity and a temperature stability of the filter does not exceed 1 ppm/°C.

31. A filter as claimed in any one of claims 1, 2 or 3 wherein the filter has more than one cavity and a temperature stability of the filter does not exceed ½ ppm/°C.

32. A filter as claimed in any one of claims 1, 2 or 3 wherein said dielectric material is made of a titanium oxide base material.

33. A method of constructing and compensating a microwave filter having a first cavity resonating at an operating frequency in at least two orthogonal modes substantially simultaneously, said cavity being made of a material having a coefficient of thermal expansion and having a volume that changes with temperature, said method comprising the steps of selecting one amount and type of dielectric material to be contained within said cavity for each mode, selecting the amount of dielectric material so that the dielectric material does not resonate at the operating frequency of the cavity, selecting the dielectric material with a dielectric constant and a temperature coefficient for the dielectric constant to compensate for changes in the volume in the cavity with temperature to at least reduce a variation in said operating frequency that would otherwise be caused by a temperature-induced volume change of said cavity.

34. A method as claimed in claim 33 including the steps of selecting the location of the dielectric material in the cavity for each mode.

35. A method as claimed in claim 34 including the steps of selecting the dielectric constant and the temperature coefficient of the dielectric constant for the dielectric material so that a variation in operating frequency that would otherwise result from any increase or decrease in temperature due to a change in volume of the cavity is approximately balanced by the variation in operating frequency that results from the change in the dielectric constant with temperature, thereby maintaining the operating frequency of the cavity substantially constant with temperature.

36. A method as claimed in any one of claims 33, 34 or 35 wherein the amount of dielectric material contained within the cavity is adjustable externally, said method including the steps of constructing the filter and operating the filter with a first fixed amount of dielectric material in said cavity for each mode, varying the temperature of the cavity and determining the temperature stability of the filter based on any change in the operating frequency in the filter with temperature, deciding whether the temperature stability of the filter is at an acceptable level, if said temperature stability of said filter is not at an acceptable level, varying the amount of dielectric material in said cavity for each mode to a second fixed amount and operating the filter while varying the temperature of the cavity, determining the temperature stability of said filter and repeating the steps of varying the amount of dielectric material contained in the cavity for each mode and operating the filter at varying temperatures until the temperature stability of the filter is at an acceptable level.

37. A method as claimed in any one of claims 33, 34 or 35 wherein said amount of dielectric material contained within the cavity is adjustable externally, said method including the steps of determining each amount of dielectric material within each cavity to ensure that an amount of dielectric material within a first cavity for a first mode is exactly the same as the amount of dielectric material within the cavity for a second mode, each cavity having two ends, said steps using means to measure a frequency of resonance peaks from reflection for each mode, said steps including simultaneously exciting said first cavity with a first mode from one end and a second mode from an opposite end, said modes being rotated 90° from one another, determining the frequency of the resonance peak for each mode, adjusting at least one of the dielectric screws until a frequency of the resonance peaks are identical for the first and second modes.

38. A method as claimed in any one of claims 33, 34 or 35 wherein said method includes the steps of selecting a dielectric material having a dielectric constant greater than thirty.

39. A method as claimed in any one of claims 33, 34 or 35 wherein said method includes the steps of selecting a dielectric material having a temperature coefficient of the dielectric constant greater than −200 ppm/°C.

40. A method as claimed in any one of claims 33, 34 or 35 wherein the method includes the steps of selecting a dielectric material having a Q greater than 1000.

41. A method as claimed in any one of claims 33, 34 or 35 wherein said method includes the steps of selecting a dielectric material having a dielectric constant greater than 80.

42. A method as claimed in any one of claims 33, 34 or 35 wherein said method includes the steps of selecting a dielectric material having a temperature coefficient of the dielectric constant greater than −400 ppm/°C.

43. A method as claimed in any one of claims 33, 34 or 35 wherein said method includes the steps of selecting a dielectric material having a Q greater than 4000.

44. A method as claimed in any one of claims 33 or 34 wherein said method includes the step of selecting the dielectric material with a dielectric constant to compensate for changes in volume in the cavity with temperature to minimize a variation in said operating frequency that would otherwise be caused by a temperature-induced volume change of said cavity.

45. A filter as claimed in any one of claims 1, 2 or 3 wherein said dielectric constant has a temperature coefficient greater than +200 ppm/°C.

46. A filter as claimed in any one of claims 1, 2 or 3 wherein said dielectric constant has a temperature coefficient greater than +400 ppm/°C.

47. A method as claimed in any one of claims 33, 34 or 35 wherein said method includes the steps of selecting a dielectric material having a temperature coefficient of the dielectric constant greater than +200 ppm/°C.

48. A method as claimed in any one of claims 33, 34 or 35 wherein said method includes the steps of selecting a dielectric material having a temperature coefficient of the dielectric constant greater than +400 ppm/°C.

* * * * *